US008857753B1

(12) United States Patent
Calhoun

(10) Patent No.: US 8,857,753 B1
(45) Date of Patent: Oct. 14, 2014

(54) SPLIT-FLANGE REEL AND ASSOCIATED DISASSEMBLY/TRANSPORT RACK SYSTEM

(75) Inventor: Franklin Calhoun, Carrollton, GA (US)

(73) Assignee: Southwire Company, LLC, Carrollton, GA (US)

( * ) Notice: Subject to any disclaimer, the term of this patent is extended or adjusted under 35 U.S.C. 154(b) by 502 days.

(21) Appl. No.: 13/225,948

(22) Filed: Sep. 6, 2011

(51) Int. Cl.
*B65H 75/14* (2006.01)
*B65H 75/22* (2006.01)

(52) U.S. Cl.
USPC ..... 242/608.4

(58) Field of Classification Search
CPC ..... B65H 75/14; B65H 75/22
USPC ..... 242/607, 608, 608.2, 608.3, 608.4, 242/608.5, 609, 609.1, 609.2, 609.3, 118.4, 242/118.6, 118.61, 118.62
See application file for complete search history.

(56) References Cited

U.S. PATENT DOCUMENTS

| | | | | | |
|---|---|---|---|---|---|
| 1,905,488 | A | * | 4/1933 | Nack | 206/399 |
| 1,915,825 | A | * | 6/1933 | Hescock | 242/608.4 |
| 1,972,572 | A | * | 9/1934 | Nack | 242/601 |
| 2,061,365 | A | | 11/1936 | Markle | |
| 2,225,551 | A | | 12/1940 | Clinton | |
| 2,285,732 | A | | 6/1942 | Markle | |
| 2,397,362 | A | | 3/1946 | Markle | |
| 2,494,521 | A | * | 1/1950 | Emery et al. | 242/607 |
| 2,881,985 | A | | 4/1959 | Overmire | |
| 3,056,563 | A | | 10/1962 | Whitnah | |
| 3,970,268 | A | * | 7/1976 | Sheetz | 242/609.2 |
| 4,039,156 | A | | 8/1977 | Abraham | |
| 4,066,224 | A | * | 1/1978 | Hargreaves et al. | 242/608.4 |
| 5,605,305 | A | | 2/1997 | Picton | |
| 5,803,396 | A | | 9/1998 | Dewaele | |
| 5,971,317 | A | * | 10/1999 | Jaros | 242/614 |
| 6,352,216 | B1 | | 3/2002 | Coats | |
| 6,478,249 | B1 | | 11/2002 | Orzel | |
| 8,608,102 | B2 | * | 12/2013 | Brennaman | 242/608 |
| 2011/0089285 | A1 | | 4/2011 | Chambers et al. | |
| 2014/0027562 | A1 | | 1/2014 | Chambers et al. | |

FOREIGN PATENT DOCUMENTS

| | | |
|---|---|---|
| FR | 2674233 | 9/1992 |
| WO | WO/94/12422 | 6/1994 |

OTHER PUBLICATIONS

U.S. Office Action dated Dec. 27, 2012 in U.S. Appl. No. 12/905,550.

* cited by examiner

*Primary Examiner* — William E Dondero
(74) *Attorney, Agent, or Firm* — Hartman & Citrin LLC

(57) ABSTRACT

A split-flange reel and a system and method for disassembling and transporting the same are provided. The split-flange reel comprises two left-side flange-halves that are connected together to form a left-side flange and two right-side flange-halves connected together to form a right-side flange. A bolt-in drum is connected between the flanges, and an arbor tube is connected to the left-side flange-halves and passes through the left-side flange, the bolt-in drum, and the right-side flange. A disassembly/transport rack comprises a base, a number of upright members, and an alignment tube and is configured to hold the split-flange reel for disassembly and to store the left-side and right-side flange-halves of the disassembled split-flange reel for transport.

14 Claims, 12 Drawing Sheets

SPLIT-FLANGE REEL AND ASSOCIATED DISASSEMBLY/TRANSPORT RACK SYSTEM

BACKGROUND

Electrical wire and cable may be shipped from a manufacturer to a job site wound on a reel for payoff during installation. Bulky cable, such as large gauge and/or long lengths of copper or aluminum conductors used for underground or overhead electrical transmission, may be shipped on oversized, heavy-duty steel reels. The steel reels may be as large 12 feet in diameter and 8 feet wide in order to hold the length and weight of the cable wound on the reel. In addition, the steel reels are reusable, and are traditionally shipped back to the manufacturer once installation of the cable is complete.

Because of the weight and size of a loaded, over-sized steel reel, usually only one reel may be transported per truck from the manufacturer to the job site. Because of the diameter of the reel, transport of the reel to the job site may further require a specialized vehicle, such as a "lowboy" flatbed trailer. However, once the cable is unloaded from the reel, the dimensions and volume of the empty steel reel may still result in only one or two empty reels being returned to the manufacturer per lowboy trailer. For example, a job requiring 40 such reels of cable would require 40 lowboy trucks for transport of the cable to the jobsite, and 20 or more trucks to return the steel reels to the manufacturer, increasing the cost of transportation of the cable and return of the empty reels.

It is with respect to these considerations and others that the disclosure made herein is presented.

SUMMARY

It should be appreciated that this Summary is provided to introduce a selection of concepts in a simplified form that are further described below in the Detailed Description. This Summary is not intended for use in limiting the scope of the claimed subject matter.

A split-flange reel and a system and method for disassembling and transporting the same are described herein. According to one embodiment, the split-flange reel comprises two left-side flange-halves that are connected together to form a left-side flange and two right-side flange-halves connected together to form a right-side flange. A bolt-in drum is connected between the flanges, and an arbor tube is connected to the left-side flange-halves and passes through the left-side flange, the bolt-in drum, and the right-side flange.

According to another embodiment, a method for disassembling the split-flange reel for transport comprises placing the split-flange reel in a disassembly/transport rack. The upper left-side flange-half is disconnected from the lower left-side flange-half and removed. The upper left-side flange half is then set aside. Similarly, the upper right-side flange-half is disconnected from the lower right-side flange-half, removed, and set aside. The arbor tube and a bolt-in drum are removed from the split-flange reel, and then the lower right-side flange-half and lower left-side flange-half are removed from the disassembly/transport rack and set aside. An alignment tube is installed in the base of the disassembly/transport rack, and the left-side and right-side flange-halves are loaded into the rack in alignment with the alignment tube for transport in the rack.

In another embodiment, a system comprises a split-flange reel having two left-side flange-halves connected together to form a left-side flange, two right-side flange-halves connected together to form a right-side flange, a bolt-in drum disposed between the flanges, and an arbor tube connected to the left-side flange-halves and passing through the left-side flange, the bolt-in drum, and the right-side flange. The system further comprises a disassembly/transport rack having a base, a number of upright members, and an alignment tube. The disassembly/transport rack is configured to hold the split-flange reel for disassembly and to store the left-side and right-side flange-halves of the disassembled split-flange reel for transport.

Other apparatus, systems, and methods according to embodiments will be or become apparent to one with skill in the art upon review of the following drawings and Detailed Description. It is intended that all such additional apparatus, systems, and/or methods be included within this description, be within the scope of the present invention, and be protected by the accompanying claims.

DETAILED DESCRIPTION

Figure 1:
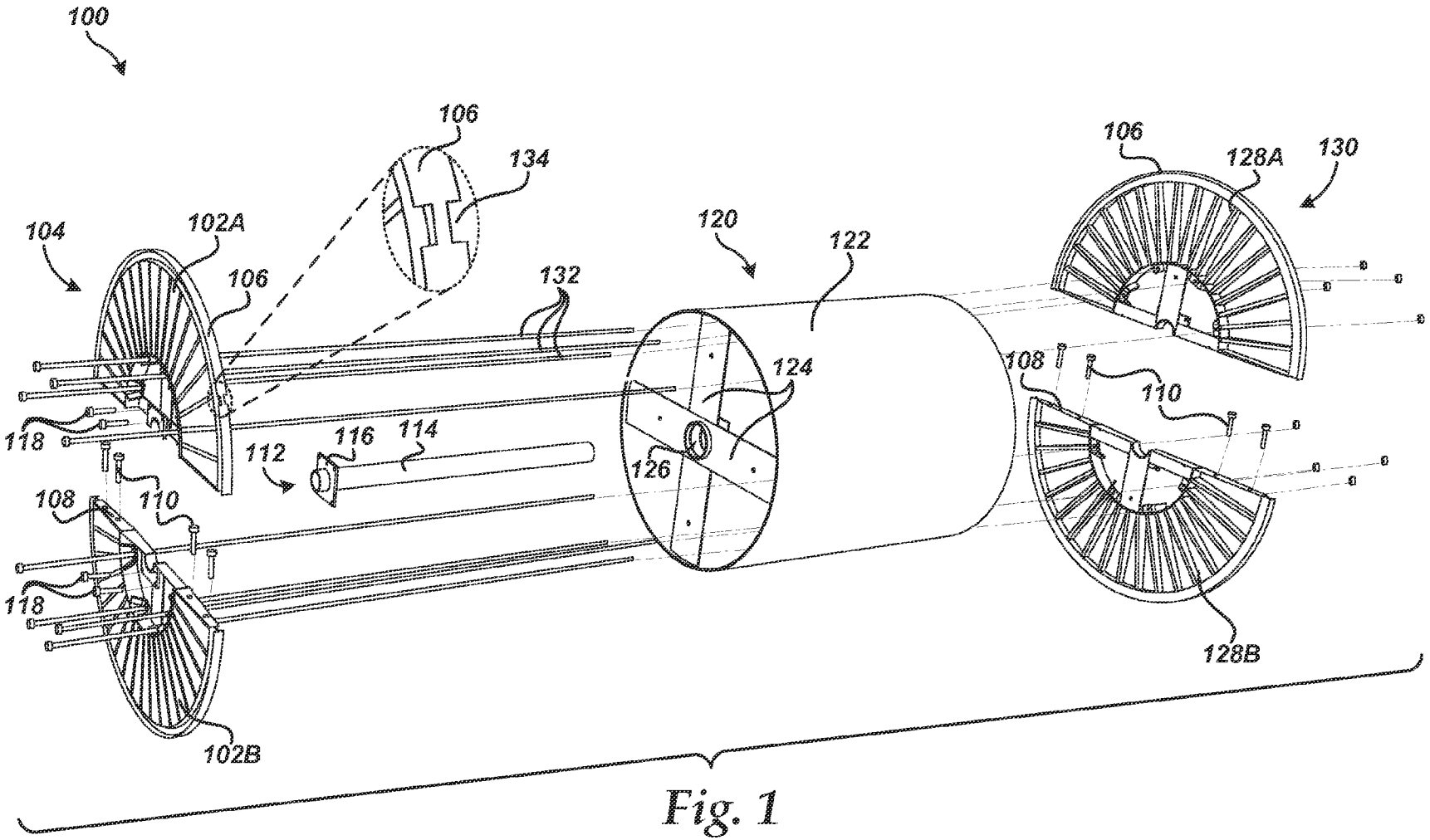
FIG. 1 is an explosion view showing the components of an exemplary split-flange reel assembly, according to various embodiments presented herein.

The following detailed description is directed to a split-flange reel and a system and method for disassembling and transporting the same. As described above, oversized, heavy-duty steel reels may be used to ship bulky cabling to the job site. These steel reels are reusable and the empty reels are traditionally shipped back to the manufacturer once installation of the cable is complete. However, even though relieved of the weight of the loaded cable, the dimensions and volume of the empty steel reel may still result in only one or two empty reels being returned to the manufacturer per truck or low-boy trailer. Thus a job requiring 40 such reels of cable could require 20 or more lowboy trucks to return the steel reels to the manufacturer.

The split-flange reel described herein allows for a more compact storage for transporting the empty reels to the manufacturer. Using the disassembly and transport system described herein, the components of the split-flange reel may be broken down into smaller component trucks, allowing up to 10 split-flange reels to be transported on a conventional flatbed trailer. For example, the 40 reels used in the job described above could be returned to the manufacturer using only four trucks, thus significantly reducing the cost of returning the empty reels from the jobsite.

The split-flange reel may include two left-side flange-halves ("flange-half As"), an arbor tube, a bolt-in drum, and two right-side flange-halves ("flange-half Bs"). The two flange-half As are joined together to form the left-side flange and may be configured to attach to the arbor tube and drum using arbor tube bolts and cross arm bolts. The arbor tube provides lateral strength to the reel as well a rotation point for payoff of the loaded cabling. The bolt-in drum allows for interchangeable drums of varying diameters to be utilized in the split-flange reel depending on the length and/or size of cable being loaded on the reel. The two flange-half Bs may be joined together to form the right-side flange and may be configured to attach to the assembled left-side flange with a number of through-bolts that pass through the drum. The flange-half Bs may be further configured to attach to the drum in a similar fashion to the flange-half As.

The disassembly/transport system may comprise a rack with clamps that are used during the disassembly of the split-flange reel. The rack may further include an alignment tube that is used to facilitate alignment and storage of the flanges in the rack for transport. The system may further comprise a flange hook that slips onto an outer flange tire of the flanges to provide a safe, slip-free lift point for attaching a sling, rope, or other lifting system to the flange. In addition, methods for utilizing the rack and/or flange hook to disassemble the split-flange reel and store the flanges for transport is provided. These and other components, systems, and methods will be described in more detail below in regard to the various embodiments presented herein.

In the following detailed description, references are made to the accompanying drawings that form a part hereof, and that show by way of illustration specific embodiments or examples. The drawings are not drawn to scale. Accordingly, the dimensions or proportions of particular elements, or the relationships between those different elements, as shown in the drawings are chosen only for convenience of description, but do not limit possible implementations of this disclosure. Like numerals represent like elements throughout the several figures.

FIG. 1 shows an explosion view of an assembly of an exemplary split-flange reel 100, according to one embodiment. As described above, the split-flange reel 100 may include two flange-half As 102A, 102B (referred to herein as flange-half A 102) joined together to form the left-side flange 104. The flange-half A 102 may be half-round in shape and made of a combination of aluminum, steel, plastic, composite, or any other durable, rigid material components welded or otherwise connected together. The flange-half A 102 may include a flange tire 106 along the round edge and flat portions, such as flat portion 108, along the straight edge. The flat portions 108 may include a number of threaded or non-threaded bolt holes that allow the two flange-half As 102A and 102B to be assembled together using flange bolts, such as flange bolts 110, to form the left-side flange 104.

The split-flange reel 100 may also include an arbor tube 112. The arbor tube may provide lateral strength in the split-flange reel 100 assembly as well as allow for rotation of the reel during payoff of the loaded cable. The arbor tube 112 may comprise a hollow tube 114 with a connecting bracket 116 welded or otherwise attached near one end of the tube. The connecting bracket 116 may include a number of threaded or non-threaded bolt holes that allow the assembled left-side flange 104 to be connected to the arbor tube 112 using arbor tube bolts 118.

The split-flange reel 100 may also include a bolt-in drum 120. The bolt-in drum 120 may allow for interchangeable drum diameters to be utilized in the split-flange reel 100 depending on the length and/or size of cable being loaded on the reel. The bolt-in drum 120 may comprise a cylinder 122 open at either end, with cross arms 124 welded or otherwise attached in the open ends. The cross arms 124 may form an aperture 126 about the central axis of the cylinder 122 through which the arbor tube 112 may pass during assembly of the split-flange reel 100. The cross arms 124 may further include a number of threaded or non-threaded bolt holes that allow the assembled left-side flange 104 and the assembled right-side flange 130 to be connected to the bolt-in drum 120 using cross arm bolts (not shown).

The split-flange reel 100 further includes two flange-half Bs 128A, 128B (referred to herein generally as flange-half B 128) joined together to form the right-side flange 130. The flange-half B 128 may be of similar shape and construction as the flange-half A 102 described above. The flange-half B 128 may include the flange tire 106 along the round edge and flat portions, such as flat portion 108, along the straight edge. The flat portions 108 may include a number of threaded or non-threaded bolt holes that allow the two flange-half Bs 128A and 128B to be assembled together using flange bolts, such as flange bolts 110, to form the right-side flange 130. The flange-half B 128 may be further configured to attach to the cross arms 124 of the bolt-in drum 120 in a similar fashion to the flange-half A 104, described above.

The assembled right-side flange 130 may be connected to the left-side flange 104 using a number of through-bolts, such as through-bolts 132. Each through-bolt 132 may pass through an aperture in a bracket or other portion of the left-side flange 104, through the cylinder 122 of the bolt-in drum 120, and through a corresponding aperture in a bracket or other portion of the right-side flange 130. The through-bolt 132 may be further secured by a nut or other fastener. According to one embodiment, the assembled right-side flange 130 is connected to the left-side flange 104 using eight through-bolts 132 passing through brackets spaced evenly around an inner circumference of the flange-half As 102A and 102B and corresponding brackets of the flange-half Bs 128A and 128B, as will be described in more detail below in regard to FIGS. 2A-3B. In another embodiment, the flange tire 106 of each flange-half A 102 and flange-half B 128 includes a slot 134 or other opening that allows a flange hook to slip onto the outer flange tire 106 of the flanges to provide a safe, slip-free lift point for attaching a sling, rope, or other lifting system to the flange, as will be described in more detail below in regard to FIG. 10.

Figure 2B:
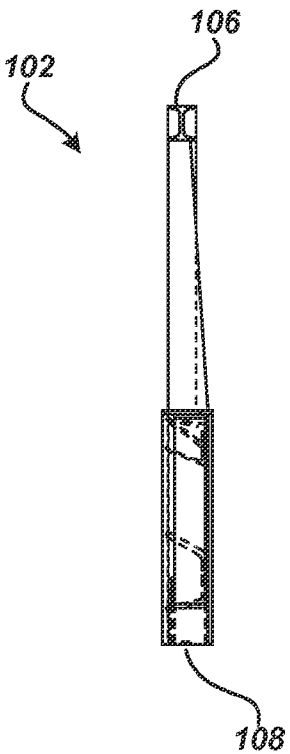
FIGS. 2A and 2B are a side view and sectional view, respectively, showing details of a flange-half A component of the split-flange reel assembly, according to various embodiments presented herein.
Figure 2A:
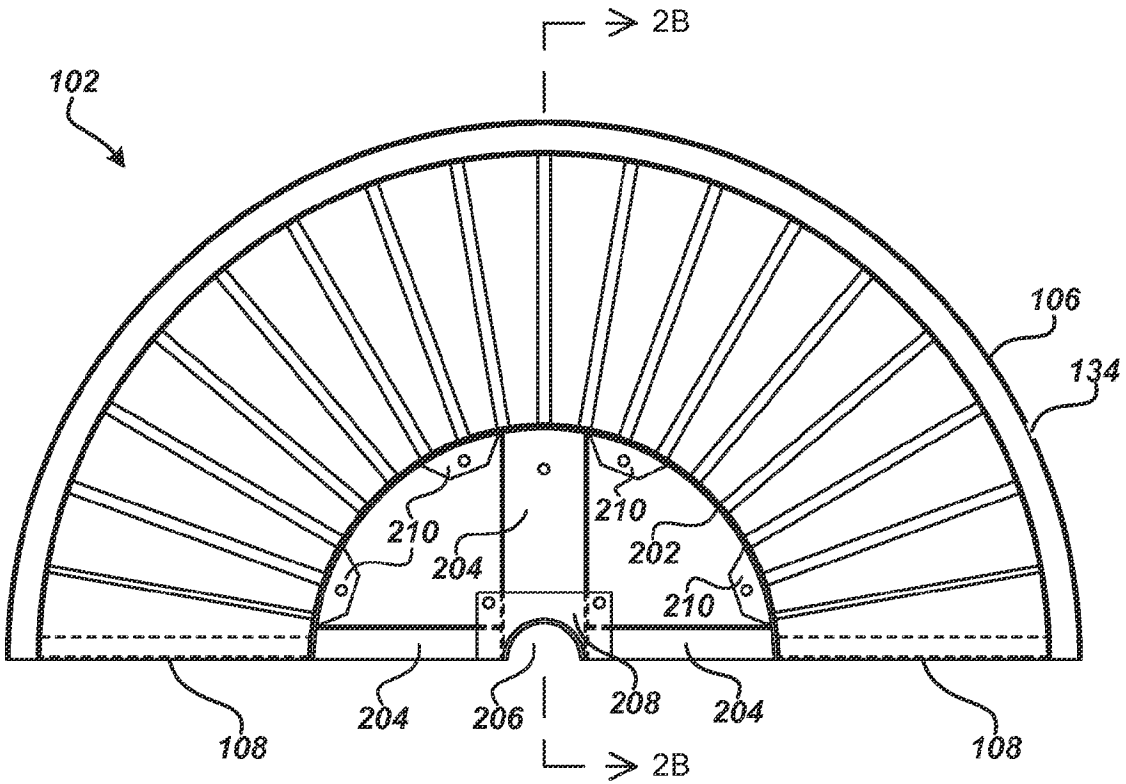

FIGS. 2A and 2B show additional details regarding the flange-half A 102, according to embodiments. As described above, the flange-half A 102 may be half-round in shape and include an outer circumference comprising the flange tire 106 and inner circumference 202. A number of structural members 204 may be welded or otherwise attached to the inner circumference 202 of the flange-half A 102 to form a partial aperture 206. When the two flange-half As 102A and 102B are connected together along the flat portions 108, as described above, the two partial apertures 206 form an aperture through which the arbor tube 112 may pass. In addition, an end plate 208 may be welded or otherwise connected to the structural members 204 allowing the flange-half A 102 to be connected to the connecting bracket 116 of the arbor tube 112. The end plate 208 may include a number of threaded or non-threaded bolt holes that allow the end plate 208 to be connected to the connecting bracket 116 of the arbor tube.

The structural members 204 may further include one or more threaded or non-threaded bolt holes that allow the flange-half A 102 to be connected to the drum 120. A number of brackets 210 may be welded or otherwise attached to the inner circumference 202 of the flange-half A 102. According to one embodiment, the flange-half A 102 may include four such brackets 210 evenly spaced around the inner circumference 202, as shown in FIG. 2A. Each bracket 210 may include an aperture through which a through-bolt 132 may pass in connecting the assembled flange-half As 102A and 102B to the assembled flange-half Bs 128, as further described above. The through-bolt 132 may pass through the bracket 210 of the flange-half A 102, through the drum 120, and through a corresponding bracket on the flange-half B 128. In addition, the slot 134 in the flange tire 106 is further shown in FIG. 2A that allows a flange hook to slip onto the outer flange tire 106 of the flanges 104, 130 to provide a safe, slip-free lift point for attaching a sling, rope, or other lifting system to the flange 104, 130, as will be described in more detail below in regard to FIG. 10.

Figure 3B:
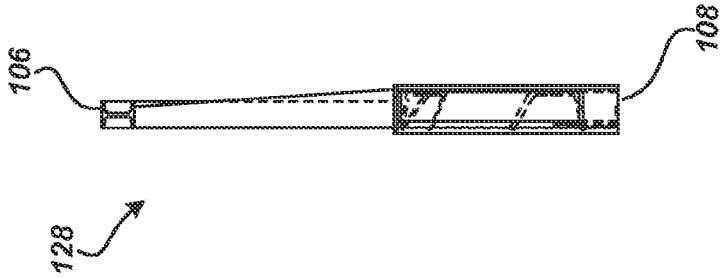
FIGS. 3A and 3B are a side view and sectional view, respectively, showing details of a flange-half B component of the split-flange reel assembly, according to various embodiments presented herein.
Figure 3A:
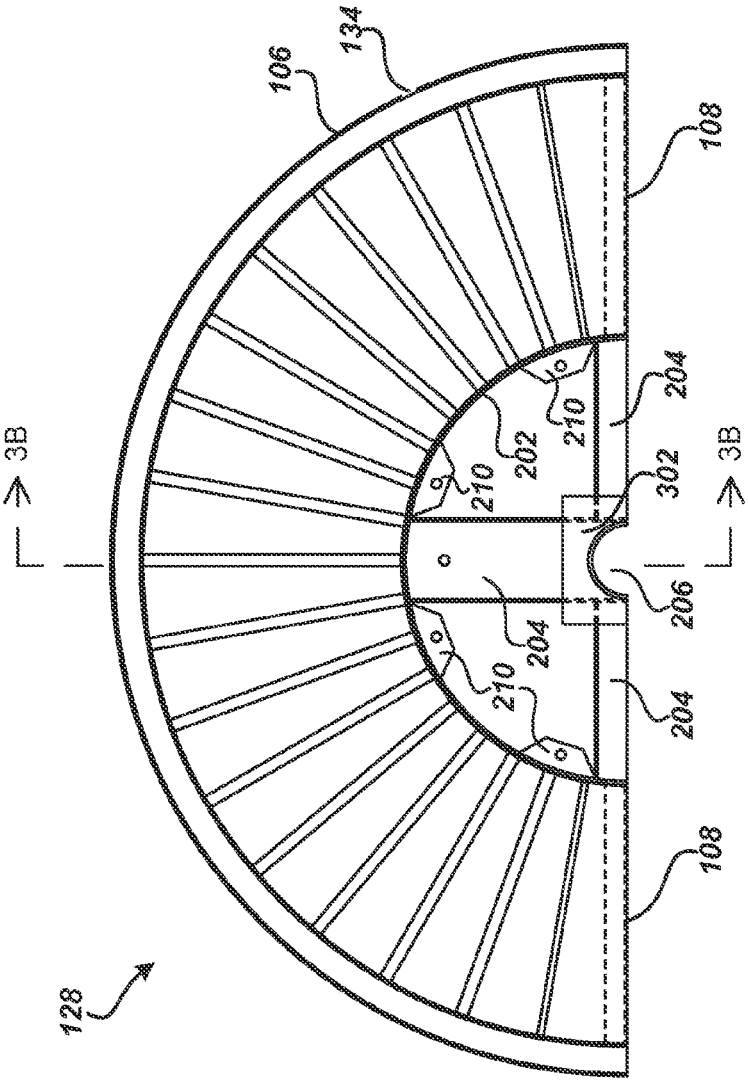

FIGS. 3A and 3B show additional details regarding the flange-half B 128, according to embodiments. The configuration of the flange-half B 128 may be substantially similar to the flange-half A 102, described above in regard to FIGS. 2A and 2B, including the outer flange tire 106, the inner circumference 202, the structural members 204, the partial aperture 206, the brackets 210, and the slot 134 in the flange tire. The structural members 204 may further include one or more threaded or non-threaded bolt holes that allow the flange-half B 128 to be connected to the drum 120. A structural plate 302 may be welded or otherwise connected to the structural members 204 to provide structural support, but may not contain bolt holes for connecting to the connecting bracket 116 of the arbor tube 112. In one embodiment, the same component may be used for the flange-half As 102 and the flange-half Bs 128 in the split-flange reel 100 assembly.

Figure 4B:
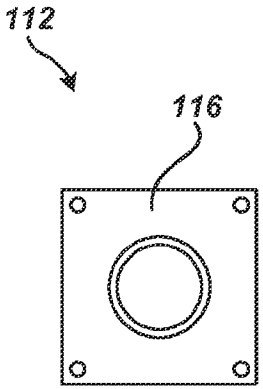
FIGS. 4A and 4B are a side view and end view, respectively, showing details of an arbor tube component of the split-flange reel assembly, according to various embodiments presented herein.
Figure 4A:
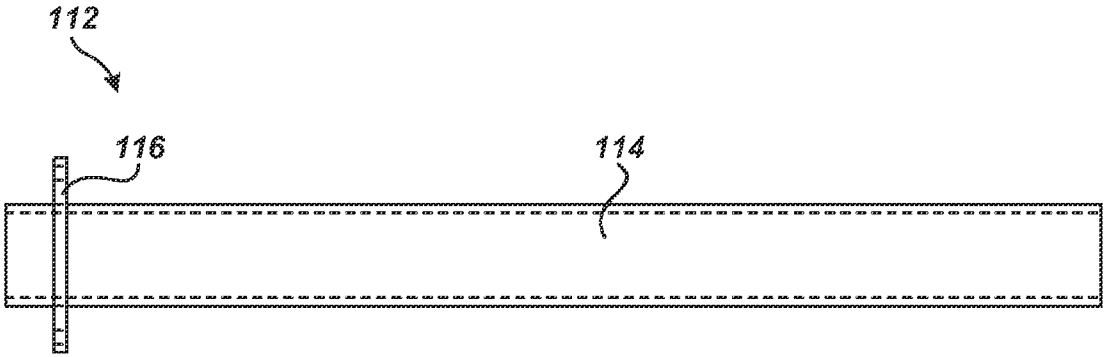

FIGS. 4A and 4B show further details of the arbor tube 112, according to further embodiments. As described above in regard to FIG. 1, the arbor tube 112 may comprise a hollow tube 114 that provides lateral strength in the split-flange reel 100 assembly as well as allow for rotation of the reel during payoff of the loaded cable. The hollow tube 114 may be made of steel, iron, plastic, composites, or any other suitable rigid material. The hollow tube 114 includes the connecting bracket 116 welded or otherwise attached near one end of the tube. The connecting bracket 116 may include a number of threaded or non-threaded bolt holes that align with the bolt holes in the end plate 208 of the flange-half A 102 allowing the assembled left-side flange 104 to be connected to the arbor tube 112 using the arbor tube bolts 118, as further described above in regard to FIG. 1.

Figure 5B:
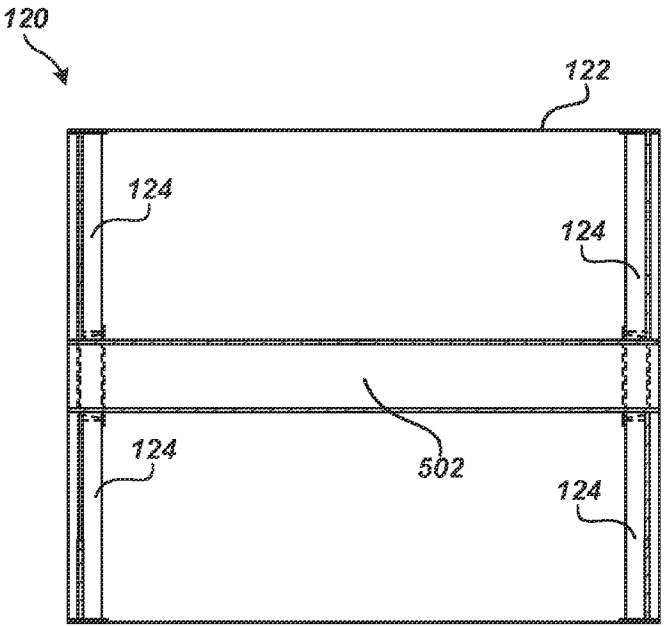
FIGS. 5A and 5B are a side view and sectional view, respectively, showing details of a bolt-in drum component of the split-flange reel assembly, according to various embodiments presented herein.
Figure 5A:
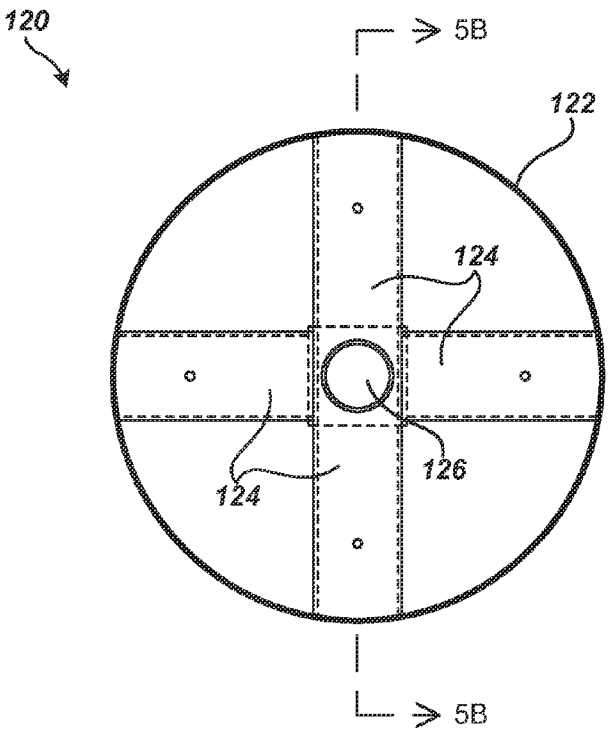

FIGS. 5A and 5B show further details of the bolt-in drum 120, according to further embodiments. As described above in regard to FIG. 1, the bolt-in drum 120 may comprise a cylinder 122 open at either end, with cross arms 124 welded or otherwise attached in the open ends. The cross arms 124 may form an aperture 126 about the central axis of the cylinder 122 through which the arbor tube 112 may pass during assembly of the split-flange reel 100. According to one embodiment, the bolt-in drum 120 includes a hollow tube 502 encompassing the central axis of the cylinder 122 and welded or otherwise attached to the cross arms 124 at either end of the drum 120. The hollow tube 502 is configured to receive the arbor tube 112 during assembly of the split-flange reel 100.

The cross arms 124 may include a number of threaded or non-threaded bolt holes that align with the bolt holes in the structural members 204 of the flange-half A 102 or flange-half B 128 allowing the assembled left-side flange 104 or right-side flange 130 to be connected to the bolt-in drum 120 using the drum bolt, as further described above in regard to FIG. 1. In one embodiment, the split-flange reel 100 components may be configured to incorporate bolt-in drums 120 with differing diameters of the cylinder 122, depending on the length and/or size of cable being loaded on the reel.

Figure 6:
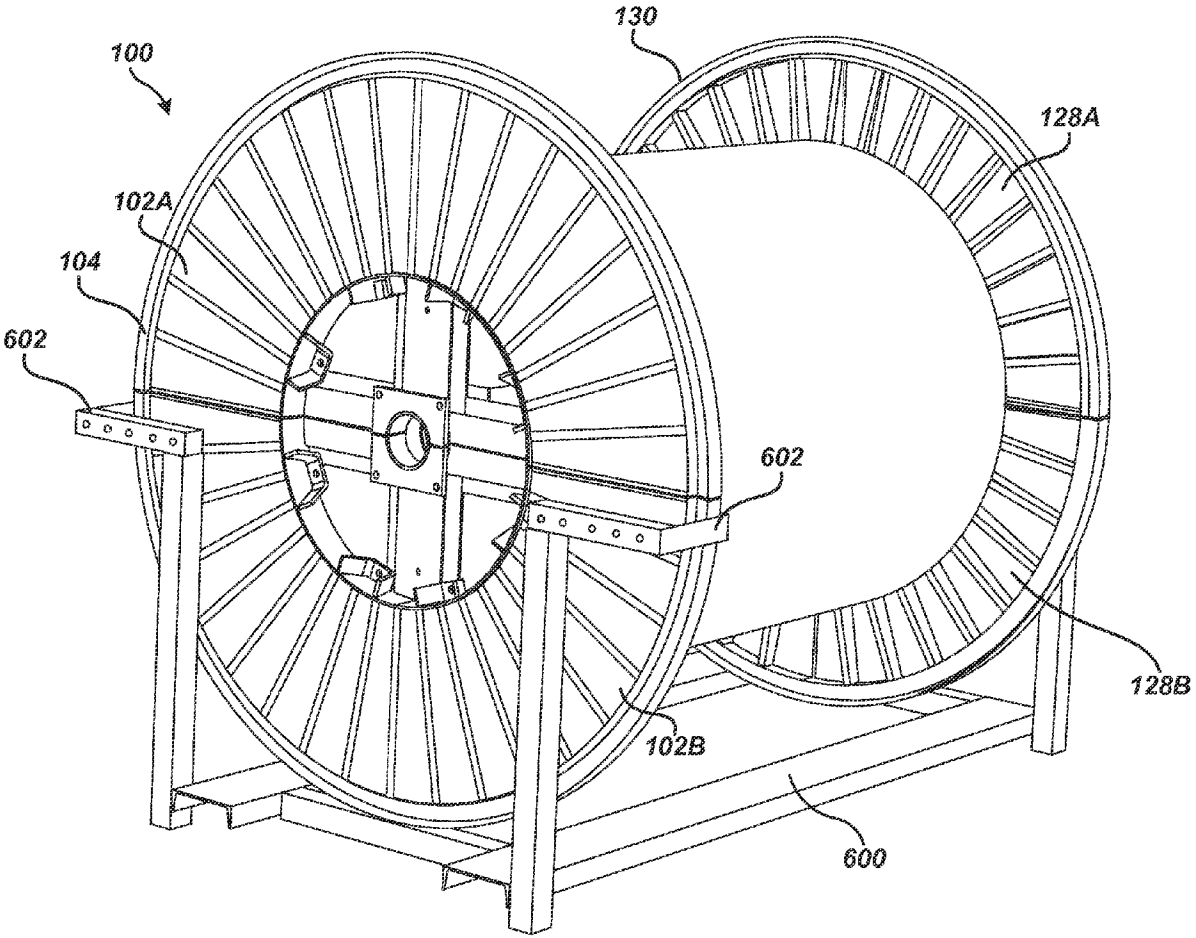
FIG. 6 is a perspective view showing the assembled split-flange reel in a disassembly/transport rack, according to various embodiments presented herein.

FIG. 6 shows the assembled split-flange reel 100 in the disassembly/transport rack 600. According to embodiments, the disassembly/transport rack 600 is configured to allow for safe and easy disassembly of the empty split-flange reel 100 for return of the reel components to the manufacturer, using a method similar to that described below in regard to FIG. 11. In addition, the disassembly/transport rack 600 provides for the transport of the flange-halves 102, 128 of the disassembled split-flange reel(s) 100 to the manufacturer.

Because the flange-halves 102, 128 are half the vertical height of the assembled split-flange reel 100, the flange-halves and the disassembly/transport rack 600 may be transported on a conventional flatbed trailer, thus reducing the cost of returning split-flange reels to the manufacturer. In addition, the disassembly/transport rack 600 may provide for the transport of flange-halves 102, 128 from more than one disassembled split-flange reel 100. In one embodiment, the disassembly/transport rack 600 holds up to twenty flange-halves 102, 128 for transport. Using the system, the flanges from 40 split-flange reels 100 may be disassembled and returned to the manufacturer in eight disassembly/transport racks 600, potentially allowing for all components (flange-halves 102, 128, arbor tubes 112, and drums 120) of the 40 reels to be returned to the manufacturer on two conventional flatbed trailers.

According to further embodiments, the empty split-flange reel 100 is placed into the disassembly/transport rack 600 such that one flange-half A 102A of the left-side flange 104 is on top, and the other flange-half A 102B is on bottom. This may allow for easier disassembly of the flange-halves 102. In addition, the left-side flange 104 is locked into the disassembly/transport rack 600 using a number of flange clamps 602. The flange clamps 602 may hold the left-side flange 104 and attached arbor tube 112 and drum 120 in place while the components of the split-flange reel 100 are disassembled, allowing for safer and faster disassembly of the reel.

Figure 7:
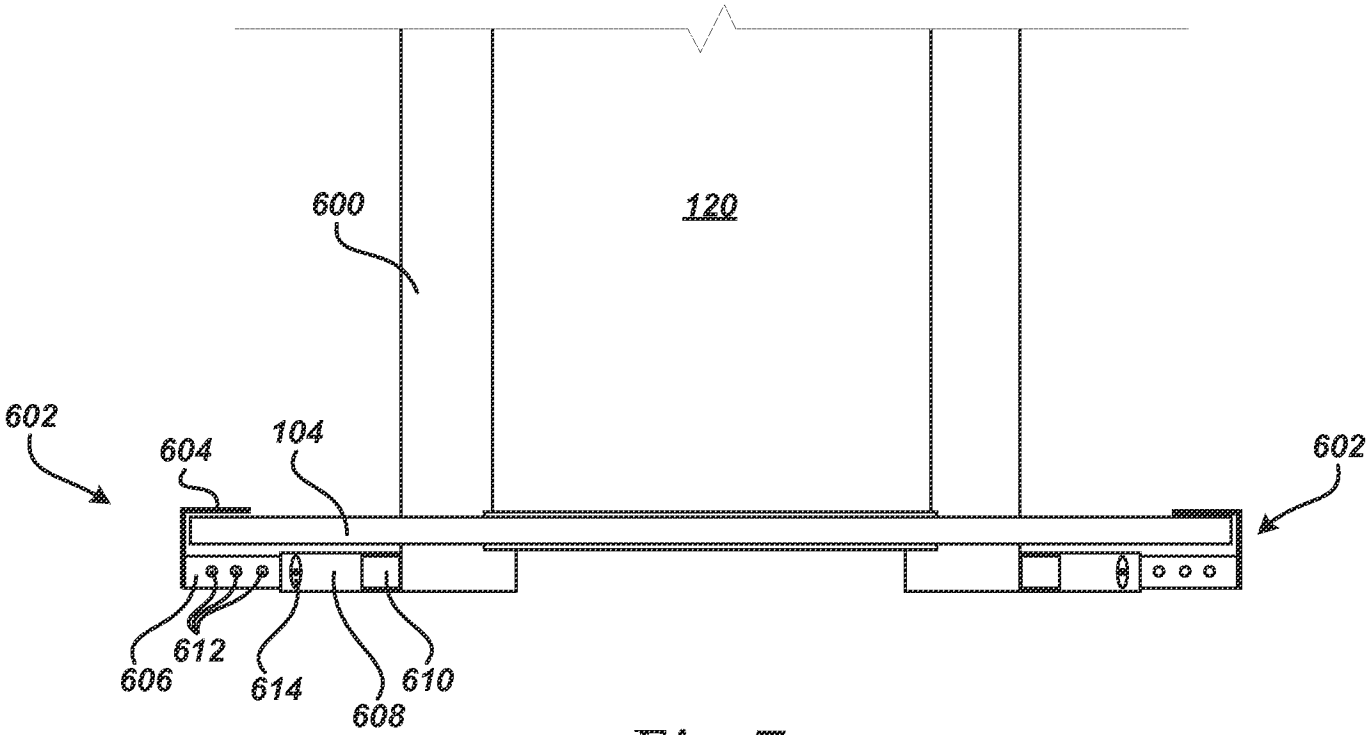
FIG. 7 is a top-down view showing details of a flange clamp component of the disassembly/transport rack, according to various embodiments presented herein.

FIG. 7 shows additional details regarding the flange clamp 602, according to one embodiment. The flange clamp 602 comprises a hook 604 that engages the outer edged of the left-side flange 104 to hold the flange upright during disassembly of the split-flange reel 100. In one embodiment, the hook 604 may be sized to hold flanges 104, 130 of varying widths yet still securely lock the flanges into the disassembly/transport rack 600. The hook 604 may be made of flat steel, iron, plastic, composites, or any other suitable rigid material. The hook 604 may be attached to an adjustable arm 606. The adjustable arm 606 may engage an extension tube 608 such that the adjustable arm may be extended outward from the extension tube to allow for placement of the split-flange reel 100 into the disassembly/transport rack 600, and then be retracted inward such that the hook 604 engages the left-side flange 104, as shown in FIG. 7.

The extension tube 608 may be welded or otherwise attached to an upright member 610 of the disassembly/transport rack 600, as shown in FIGS. 6 and 7. The adjustable arm 606 may further contain a number of pin holes 612 along the axis of extension of the arm. The pin holes 612 may be engaged by a pin lock 614 located on the extension tube 608. The pin lock 614 may be removed from the extension tube 608 so that the adjustable arm may be freely extended and retracted to engage the left-side flange 104 of the split-flange reel 100, and then replaced in the extension tube and through one of the pin holes 612 in the adjustable arm 606 to lock the flange clamp 602 into position.

It will be appreciated that the disassembly/transport rack 600 and attached flange clamps 602 may be configured to hold either the left-side flange 104 or the right-side flange 130, depending on the configuration of the split-flange reel 100 and/or the orientation of the reel when placed into the rack. However, because the left-side flange 104 is attached to the arbor tube 112 and the drum 120, according to one embodiment, locking the left-side flange into the flange clamps 602 may provide for easier and safer disassembly of the split-flange reel 100.

Figure 8:
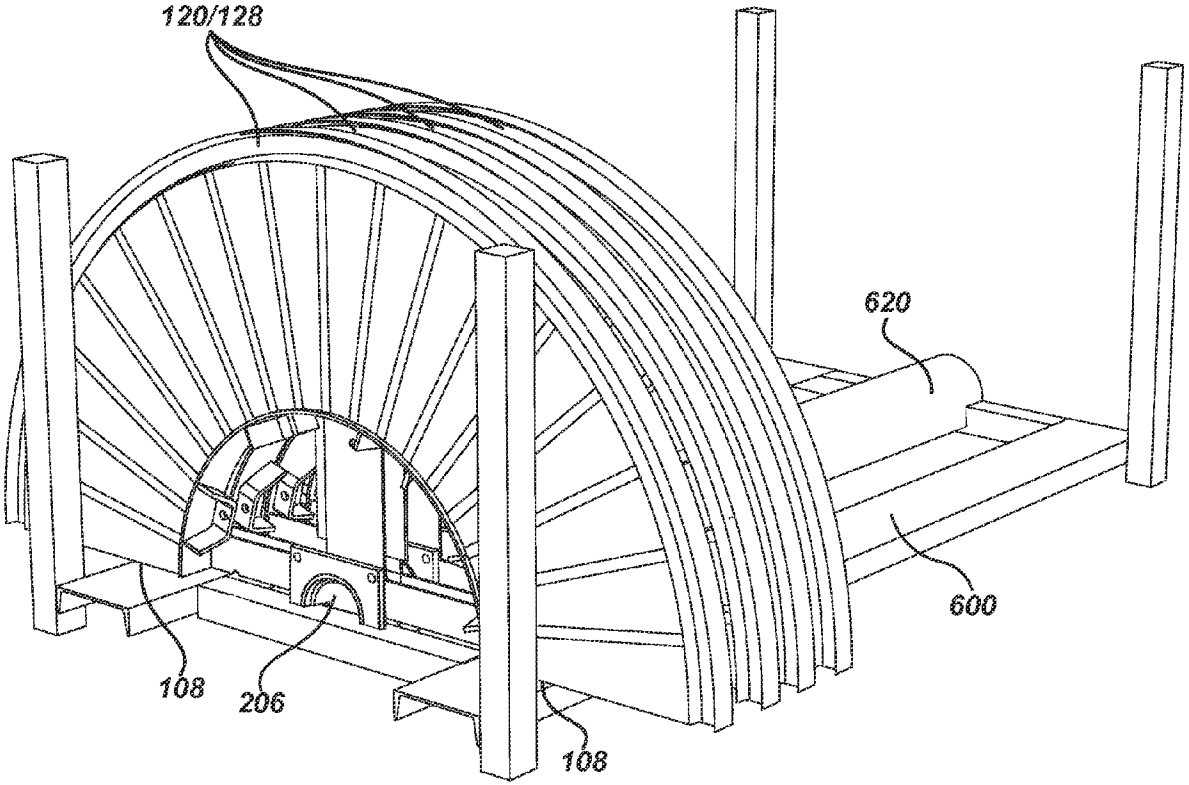
FIG. 8 is a perspective view showing disassembled flange-halves of the split-flange reel assembly stored in the disassembly/transport rack for transport, according to various embodiments presented herein.

FIG. 8 shows several flange-halves 102, 128 stored in the disassembly/transport rack 600 for transport of the flange-halves. According to embodiments, the disassembly/transport rack 600 may further include an alignment tube 620 that may be added to the rack after the empty split-flange reels 100 have been disassembled in order to facilitate alignment and storage of the flange-halves 102, 128 in the rack for transport. The alignment tube 620 may be sized and positioned in the base of the disassembly/transport rack 600 such that the partial aperture 206 of each of the flange-halves 102, 128 may engage the top surface of the alignment tube, while the flat portions 108 of the flange-halve rest on the base of the rack. To further facilitate safe transport, the flange-halves 102, 128 may be strapped or otherwise secured in the disassembly/transport rack 600 before the rack is placed on the flatbed trailer, for example.

Figure 9A:
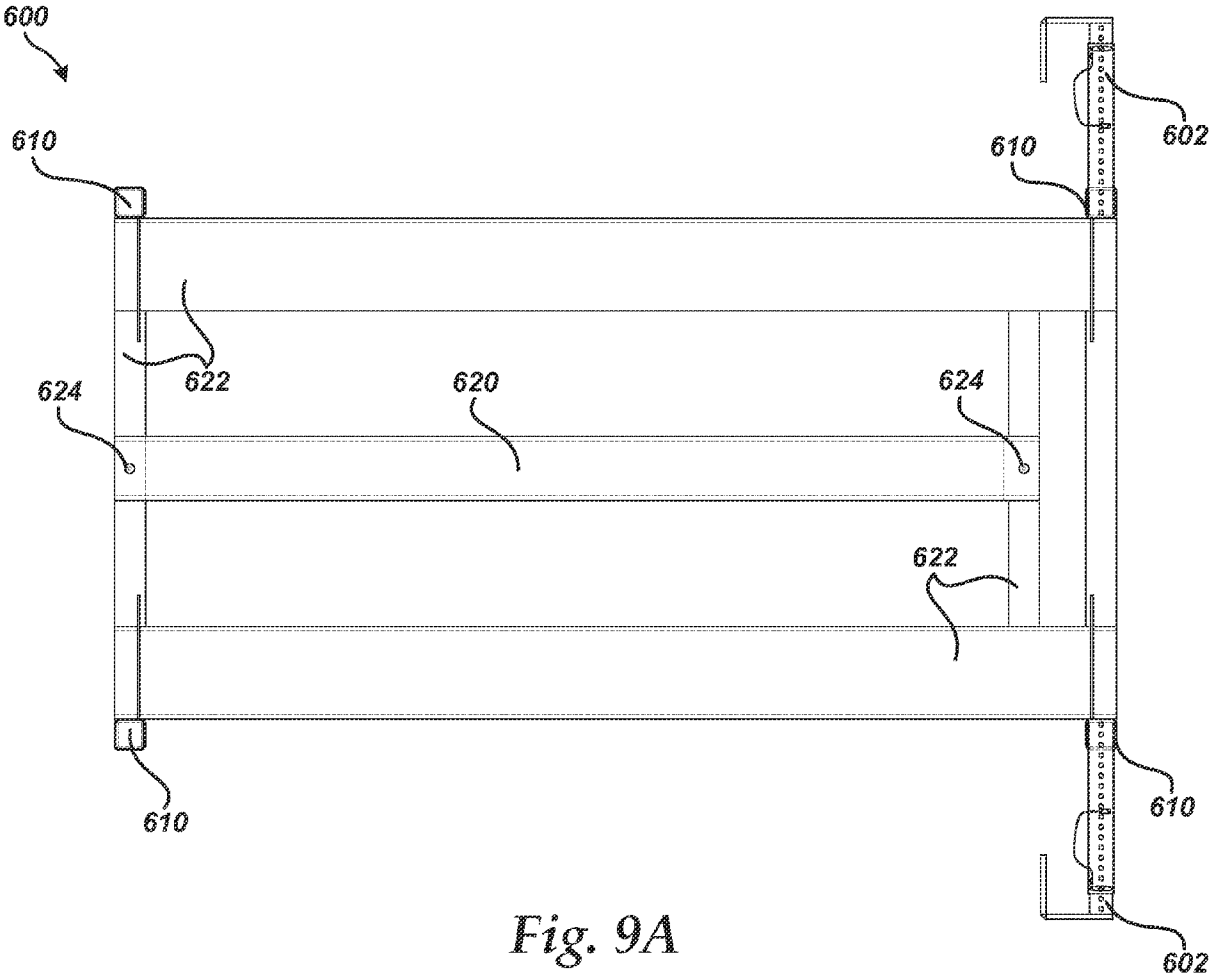
FIGS. 9A, 9B, and 9C are a top-down view, side view, and end view, respectively, showing details of the disassembly/transport rack and associated alignment tube, according to various embodiments presented herein.
Figure 9B:
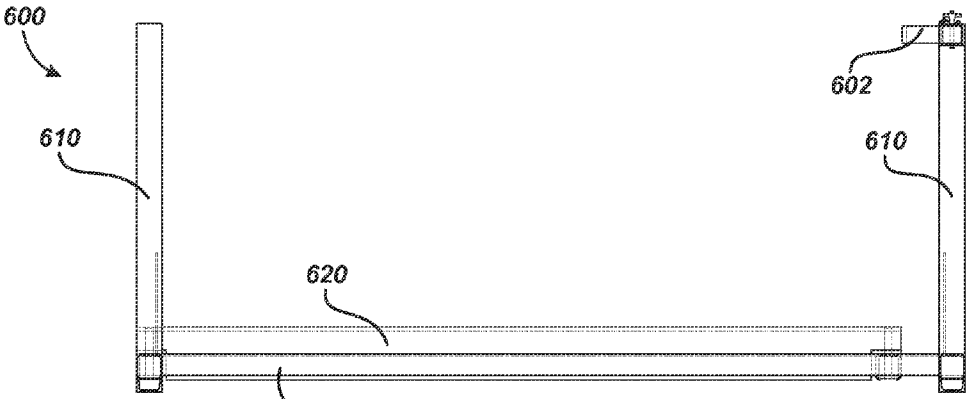
Figure 9C:
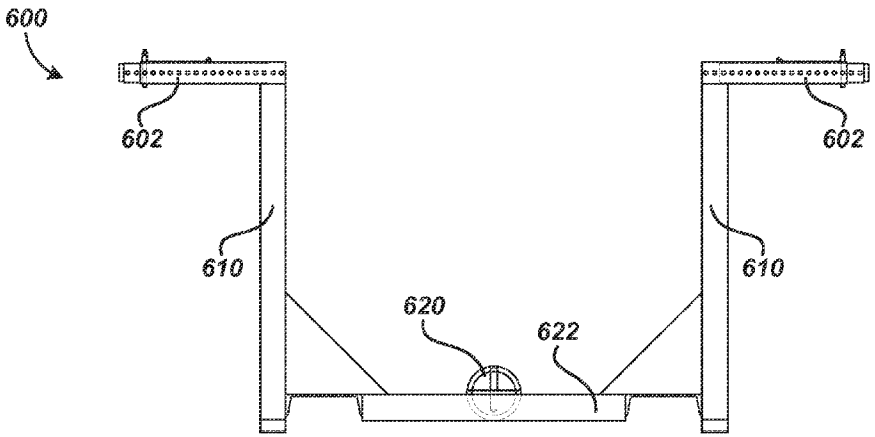

FIGS. 9A-9C show additional details regarding the disassembly/transport rack 600 with the alignment tube 620 installed, according to embodiments provided herein. The disassembly/transport rack 600 includes a base 622 and a number of upright members 610, as shown in the figures. The base 622 and upright members 610 may comprise a weldment of structural and tubular steel, for example. The base 622 and upright members 610 may be configured to hold the assembled split-flange reel 100 during disassembly of the reel 100 as well as hold a number of flange-halves 102, 128 during transport of the reel components. In one embodiment, the base 622 is further configured to facilitate lifting and positioning of the disassembly/transport rack 600 by conventional forklift, allowing the rack with stored flange-halves 102, 128, as shown in FIG. 6, to be lifted into place on a flatbed trailer for transport of the flange-halves 102, 128 to the manufacturer, for example.

As described above in regard to FIG. 7, the flange clamps 602 may be welded or otherwise attached to the upright members 610 at one end of the disassembly/transport rack 600 to hold the left-side flange 104 in place during disassembly of the split-flange reel 100. In addition, the alignment tube 620 may be installed into the base 622 of the disassembly/transport rack 600 in order to facilitate alignment and storage of the flange-halves 102, 128 in the rack 600 for transport. In one embodiment, the alignment tube 620 may further include pin locks 624 at either end that engage pin holes (not shown) in the base 622 of the disassembly/transport rack 600 to allow for easy and secure installation and removal of the alignment tube 620 from the rack 600.

Figure 10:
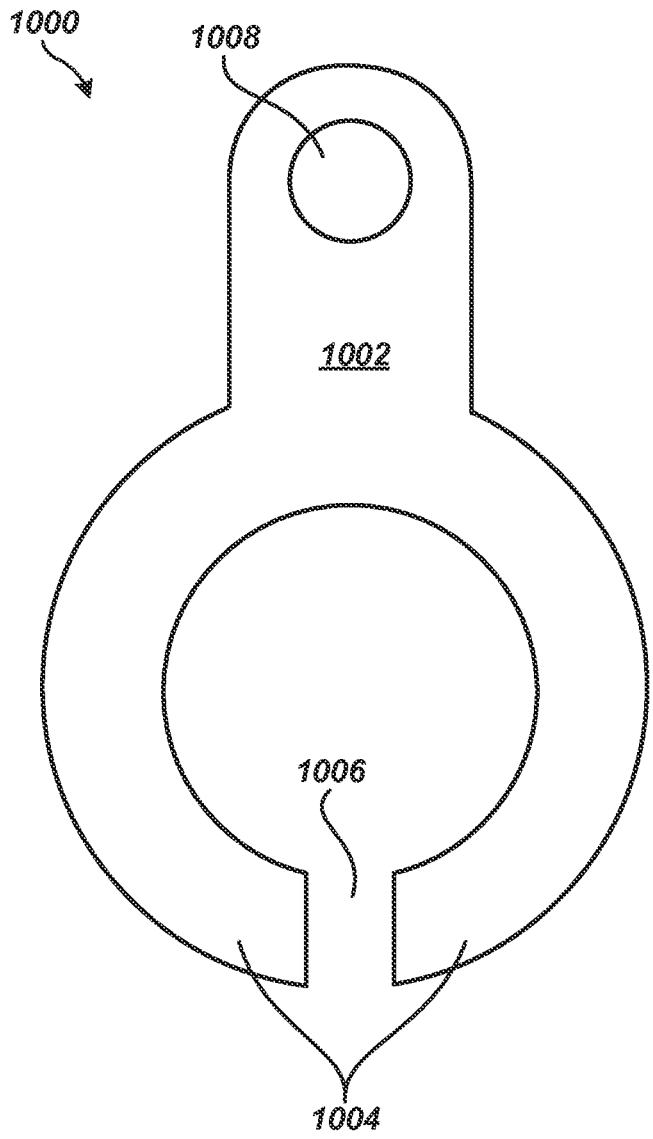
FIG. 10 is a plan view showing details of a flange hook for lifting flange-halves during disassembly of the split-flange reel, according to various embodiments presented herein.

FIG. 10 shows additional details regarding the flange hook 1000, according to one embodiment. The flange hook comprises a body portion 1002 with two semi-circular extensions 1004. The semi-circular extensions 1004 form a gap 1006 at one end of the flange hook 1000. An aperture 1008 on the opposite end of the flange hook 1000 allows the flange hook 1000 to be connected to a sling, rope, or other lifting system. According to embodiments, the semi-circular extensions 1004 and gap 1006 are configured and sized such that the flange hook 1000 may slip through the slot 134 in the outer flange tire 106 of a flange-half 102, 128 allowing the extensions to engage the inside of the flange tire 106. When the sling, rope, or other lifting system is employed to lift the flange-half 102, 128, the flange hook 1000 may be positioned at or near the top of the flange tire 106, such that the flange-half 102, 128 may be easily and safely lifted and repositioned during disassembly of the split-flange reel 100.

Figure 11:
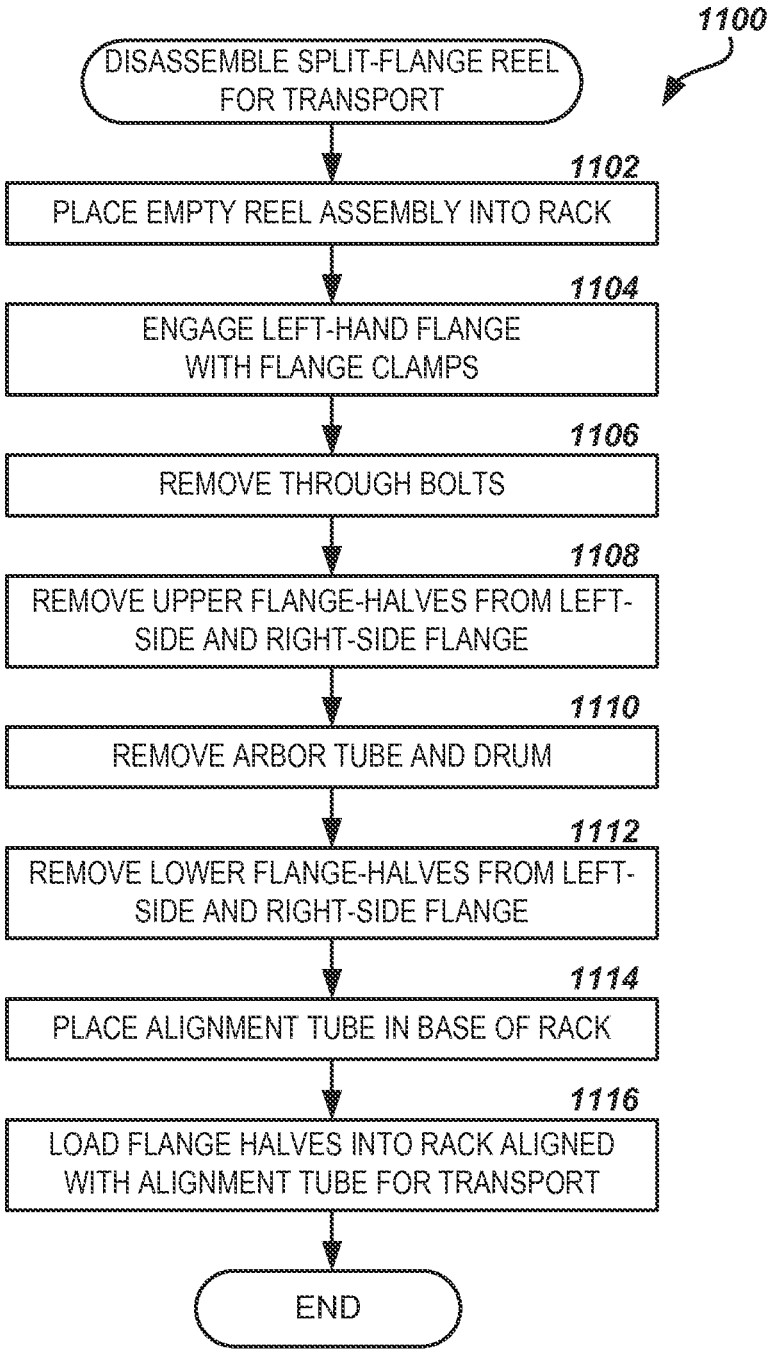
FIG. 11 is a flow diagram illustrating one method of disassembling the split-flange reel and storing the flange-halves in the disassembly/transport rack, as described in the embodiments presented herein.

FIG. 11 illustrates one routine 1100 for disassembling a split-flange reel 100 and storing the flange-halves 102, 128 in the disassembly/transport rack 600 for transport, according to embodiments described herein. The routine 1100 may be performed by one or more installers at a jobsite after the cable on the split-flange reel 100 has been unloaded during installation in order to return the empty, reusable reel 100 to the manufacturer, for example. It will be appreciated that the operations described below may be performed by the one or more installers for any number of split-flange reels 100 involved in the cable pull. It will further be appreciated that more or fewer operations may be performed than are shown in the figures and described herein, and that the operations may be performed in a different order than described.

The routine 1100 begins with operation 1102, where an empty split-flange reel 100 is placed into the disassembly/transport rack 600, as described above in regard to FIG. 6. The split-flange reel 100 is placed into the disassembly/transport rack 600 such that one flange-half A 102A of the left-side flange 104 is on top, and the other flange-half A 102B is on bottom. Similarly, placement of the split-flange reel 100 in this manner may ensure that one flange-half B 128A of the right-side flange 130 is on top, and the other flange-half B 128B is on bottom.

The routine 1100 proceeds from operation 1102 to operation 1104, where the flange clamps 602 of the disassembly/transport rack 600 are engaged with the left-side flange 104, as shown above in FIG. 7. The adjustable arms 606 may be retracted into the extension tubes 608 such that the hooks 604 engage either side of the left-side flange 104, as further shown in the figure. The pin locks 614 may then be placed in the extension tubes 608 and through one of the pin holes 612 in the adjustable arms 606 in order to lock the flange clamps 602 into position and secure the left-side flange 104 in the disassembly/transport rack 600. Next, at operation 1106, the through-bolts 132 connecting the right-side flange 130 to the left-side flange 104 are removed. According to one embodiment, because the flange-halves 102, 128 remain connected to the drum 120 via the cross arm bolts, the components of the split-flange reel 100 will remain in place after the through-bolts 132 are removed.

From operation 1106, the routine 1100 proceeds to operation 1108, where the upper flange-half A 102A of the left-side flange 104 and the upper flange-half B 128A of the right-side flange 130 are removed from the split-flange reel 100 assembly and set aside. The upper flange-half A 102A may be connected to a lifting device, such as a crane, using the flange hook 1000 described above in regard to FIG. 10. The bolts connecting the upper flange-half A 102A from the lower flange-half A 102B are then removed to separate the flange-halves of the left-side flange 104. Next, the arbor tube bolts 118 and the cross arm bolts connecting the upper flange-half A 102A to the arbor tube 112 and the drum 120, respectively, are removed, and the upper flange-half A is lifted out of position using the flange hook 1000 and set aside. The upper flange-half B 128A is then removed from the split-flange reel 100 assembly and set aside in a similar fashion to the upper flange-half A 102A.

The routine 1100 proceeds from operation 1108 to operation 1110, where the arbor tube 112 and bolt-in drum 120 are removed from the split-flange reel 100 assembly. For example, the bolt-in drum 120 may be attached to the crane or lifting device by a strap or harness, then the drum and arbor tube 112 are disconnected from the lower flange-half A 102B and lower flange-half B 128B by removing the cross arm bolts and arbor tube bolts 118, respectively. The bolt-in drum 120 may then be lifted from the assembly with the arbor tube 112 resting inside the hollow tube 502 of the drum. Next, at operation 1112, the lower flange-half A 102B and lower flange-half B 128B are removed from the split-flange reel 100 assembly and set aside. The lower flange-half A 102B and lower flange-half B 128B may be lifted from the disassembly/transport rack 600 using the crane or other lifting device, for example.

From operation 1112, the routine 1100 proceeds to operation 1114, where the alignment tube 620 is placed into position in the disassembly/transport rack 600, as shown in FIGS. 9A-9C. As further described above in regard to FIG. 9A, the pin locks 624 on the alignment tube 620 may engage the corresponding pin holes in the base 622 of the disassembly/transport rack 600 to secure the alignment tube in place. The routine 1100 then proceeds to operation 1116, where the flange-half As 102A and 102B and the flange-half Bs 128A and 128B are loaded into the disassembly/transport rack 600. According to one embodiment, each of the flange-halves 102, 128 may be lifted by the crane or other lifting device using the flange hook 1000, and lowered into place into the disassembly/transport rack 600 such that the partial aperture 206 of the flange-half engages the top surface of the alignment tube 620, while the flat portions 108 of the flange-half rest on the base 622 of the rack, as described above in regard to FIG. 8. It will be appreciated that the flange-halves 102, 128 from other split-flange reels 100 beyond the four shown in FIG. 8 and described above may also be loaded in the disassembly/transport rack 600 in operation 1116. From operation 1116, the routine 1100 ends.

While the two flanges of the split-flange reel 100 are referred to herein as the left-side flange 104 and the right-side flange 130, this is done for convenience and to more clearly describe the accompanying drawings. It will be appreciated by one skilled the art that the term left-side flange 104 generally refers to a combination of two flange-half As 102 and that the term right-side flange 130 generally refers to a combination of two flange-half Bs 128, and is not intended to limit either flange to a particular end of the split-flange reel 100 or to imply a particular orientation of the split-flange reel for assembly/disassembly. The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A split-flange reel comprising:

two left-side flange-halves removably attached to one another to form a left-side flange;

two right-side flange-halves removably attached to one another to form a right-side flange;

a bolt-in drum comprising a first end, a second end, a first cross arm located proximate the first end of the bolt-in drum, and a second cross arm located proximate the second end of the bolt-in drum, the bolt-in drum disposed between the left-side flange and the right-side flange, wherein the left-side flange is removably attached to the first cross arm and the right-side flange is removably attached to the second cross arm; and an arbor tube connected to each of the two left-side flange-halves and passing through the left-side flange, the first cross arm, the bolt-in drum, the second cross arm, and the right-side flange wherein each of the left-side flange and the right-side flange comprises a cross arm, and wherein each of the left-side flange and the right-side flange is attachable to the bolt-in drum by connecting the cross arm of the left-side flange to the first cross arm and the cross arm of the right-side flange to the second cross arm.

2. The split-flange reel of claim 1, further comprising a plurality of through-bolts connecting the left-side flange to the right-side flange.

3. The split-flange reel of claim 1, wherein the two left-side flange halves are identical to one another and the two right-side flange halves are identical to one another.

4. The split-flange reel of claim 1, wherein the two left-side flange-halves and the two right-side flange-halves are half-round in shape and configured to be removably attached to one another by a plurality of flange bolts passing through corresponding bolt holes in flat portions along a straight edge of each of the two left-side flange-halves and each of the two right-side flange-halves.

5. The split-flange reel of claim 1, wherein a left-side flange-half of the two left-side flange-halves and a right-side flange-half of the two right-side flange-halves each further comprises a slot in an outer flange tire, the slot comprising:

a first notch located along a first edge of the outer flange tire and passing through the outer flange tire; and a second notch located along a second edge of the outer flange tire and passing through the outer flange tire, wherein each of the first notch and the second notch is sized to allow an extension of a flange hook to be slipped onto the outer flange tire.

6. The split-flange reel of claim 5, further comprising the flange hook connected to the outer flange tire.

7. The split-flange reel of claim 1, wherein the split-flange reel is configured to be delivered from a manufacturer to a jobsite assembled and loaded with cable and, once empty, to be disassembled for return to the manufacturer.

8. The split-flange reel of claim 1, wherein the bolt-in drum is selected from a plurality of bolt-in drums, each of the plurality of bolt-in drums having a different diameter, the bolt-in drum selected based on a length of cable to be installed on the bolt-in drum.

9. The split-flange reel of claim 1, wherein the bolt-in drum is selected from a plurality of bolt-in drums, each of the plurality of bolt-in drums having a different diameter, the bolt-in drum selected based on a size of cable to be installed on the bolt-in drum.

10. The split-flange reel of claim 1, wherein the bolt-in drum is selected from a plurality of bolt-in drums, each of the plurality of bolt-in drums having a different diameter, the bolt-in drum selected based on a length and a size of cable to be installed on the bolt-in drum.

11. The split-flange reel of claim 1, wherein the arbor tube comprises a connecting bracket.

12. The split-flange reel of claim 1, wherein each of the two left-side flange-halves is identical in construction and each of the two right-side flange-halves is identical in construction.

13. The split-flange reel of claim 1, wherein each of the left-side flange and the right-side flange comprises an inner circumference and a plurality of structural members attached to the inner circumference.

14. The split-flange reel of claim 13, wherein the plurality of structural members are evenly spaced about the inner circumference.

* * * * *